US010689226B2

(12) United States Patent
DePaola, Jr. et al.

(10) Patent No.: US 10,689,226 B2
(45) Date of Patent: Jun. 23, 2020

(54) POSITION DETERMINING SYSTEM FOR MULTICAR ROPELESS ELEVATOR SYSTEM

(71) Applicant: Otis Elevator Company, Farmington, CT (US)

(72) Inventors: Peter DePaola, Jr., South Windsor, CT (US); Richard N. Fargo, Plainville, CT (US); David Ginsberg, Granby, CT (US); Dang V. Nguyen, South Windsor, CT (US); Shashank Krishnamurthy, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 363 days.

(21) Appl. No.: 15/546,048

(22) PCT Filed: Feb. 3, 2016

(86) PCT No.: PCT/US2016/016344

§ 371 (c)(1),
(2) Date: Jul. 25, 2017

(87) PCT Pub. No.: WO2016/126805

PCT Pub. Date: Aug. 11, 2016

(65) Prior Publication Data

US 2018/0009630 A1 Jan. 11, 2018

Related U.S. Application Data

(60) Provisional application No. 62/111,858, filed on Feb. 4, 2015.

(51) Int. Cl.
*B66B 1/30* (2006.01)
*B66B 1/34* (2006.01)
(Continued)

(52) U.S. Cl.
CPC ..... *B66B 1/30* (2013.01); *B66B 1/3492* (2013.01); *B66B 5/0031* (2013.01); *B66B 9/00* (2013.01);
(Continued)

(58) Field of Classification Search
CPC ..... B66B 1/30; B66B 1/3492
(Continued)

(56) References Cited

U.S. PATENT DOCUMENTS 3,826,928 A * 7/1974 Bucek ..... B66B 1/30 327/172
4,553,640 A * 11/1985 Inaba ..... B66B 1/285 187/292
(Continued)

FOREIGN PATENT DOCUMENTS

CN 1178838 A 4/1998
CN 104968594 A 10/2015
(Continued)

OTHER PUBLICATIONS

International Written Opinion, International Application No. PCT/US2016/016344, dated May 12, 2016, European Patent Office; Written Opinion 5 pages.
(Continued)

*Primary Examiner* — David S Warren
(74) *Attorney, Agent, or Firm* — Cantor Colburn LLP

(57) ABSTRACT

An elevator car travels in a lane (113, 115, 117) of an elevator shaft (111). A linear propulsion system imparts force to the car (214). The system includes a first part (116) mounted in the lane of the shaft and a second part (118) mounted to the elevator car configured to co-act with the first part to impart movement to the car. Car state sensors (360*a-c*) are disposed in the lane and determine a state space vector of the car within the lane. A sensed element (364) on
(Continued)

the car is sensed by the plurality of car state sensors when the car is in proximity to the respective car state sensor. A control system (225) applies an electrical current to at least one of the first part and the second part and the plurality of car state sensors communicate with the control system and the linear propulsion system to provide state space vector data.

19 Claims, 4 Drawing Sheets

(51) Int. Cl.
*B66B 11/04* (2006.01)
*B66B 9/02* (2006.01)
*B66B 5/00* (2006.01)
*B66B 9/00* (2006.01)

(52) U.S. Cl.
CPC ..... *B66B 9/02* (2013.01); *B66B 11/0407* (2013.01); *B66B 9/003* (2013.01)

(58) Field of Classification Search
USPC ..... 187/247
See application file for complete search history.

(56) References Cited

U.S. PATENT DOCUMENTS 5,503,248 A * 4/1996 Peruggi ..... B66B 13/143 187/316
5,668,421 A * 9/1997 Gladish ..... B60L 13/10 104/23.2
5,751,076 A * 5/1998 Zhou ..... B66B 11/0407 187/250
6,336,522 B1 * 1/2002 Fujita ..... B66B 1/42 187/293
7,019,421 B1 * 3/2006 Hall ..... B66B 11/0407 310/12.11
7,958,970 B2 * 6/2011 Ma ..... B66B 9/187 187/283
10,112,801 B2 * 10/2018 Madarasz ..... B66B 5/0037
2009/0000877 A1 * 1/2009 Izard ..... B66B 1/3492 187/288
2009/0057068 A1 * 3/2009 Lin ..... B66B 1/34 187/392
2010/0032246 A1 * 2/2010 Kattainen ..... B66B 1/30 187/305
2010/0038185 A1 * 2/2010 Kattainen ..... B66B 1/30 187/288
2011/0048861 A1 * 3/2011 Ma ..... B66B 9/187 187/247
2011/0127118 A1 * 6/2011 Wu ..... B66B 3/00 187/399
2012/0193169 A1 * 8/2012 Mizon ..... B66B 1/00 187/247
2015/0251877 A1 * 9/2015 Niikawa ..... B66B 5/04 187/305
2016/0194182 A1 * 7/2016 Frantzheld ..... B66B 21/12 318/4
2017/0158462 A1 * 6/2017 Roberts ..... B66B 11/0407
2017/0349396 A1 * 12/2017 Frantzheld ..... H02P 1/46
2017/0362062 A1 * 12/2017 Ginsberg ..... B66B 9/02
2018/0009630 A1 * 1/2018 Depaola, Jr. ..... B66B 1/30
2018/0009631 A1 * 1/2018 Krishnamurthy ..... B66B 1/3461
2018/0248498 A1 * 8/2018 Piitulainen ..... H02P 25/064
2018/0251343 A1 * 9/2018 Hakala ..... B66B 1/32
2019/0062104 A1 * 2/2019 Ahsaine ..... B66B 1/3492
2019/0233251 A1 * 8/2019 Hakala ..... B66B 1/30

FOREIGN PATENT DOCUMENTS

JP H06316383 A 11/1994
JP H08225268 A 9/1996
JP H08268655 A 10/1996
JP 2883776 B2 4/1999
WO 2013098486 7/2013
WO 2014113006 7/2014

OTHER PUBLICATIONS

International Search Report, International Application No. PCT/US2016/016344, dated May 12, 2016, European Patent Office; International Search Report 5 pages.
Deng Hailong, "Sensor and detection technology", China Textile Press, 2008, 9 pages.
Zhu Dewen et al., "Intelligent control elevator engineering system", China Electric Power Press, 2007, 9 pages.

* cited by examiner

POSITION DETERMINING SYSTEM FOR MULTICAR ROPELESS ELEVATOR SYSTEM

CROSS REFERENCE TO RELATED APPLICATIONS

This is a U.S. National Stage of International Application No. PCT/US2016/016344, filed on Feb. 3, 2016, which claims the benefit of U.S. Provisional Patent Application No. 62/111,858, filed on Feb. 4, 2015, the disclosures of which are incorporated herein by reference.

BACKGROUND OF THE INVENTION

The subject matter disclosed herein generally relates to the field of elevators, and more particularly to a multicar, ropeless elevator system having a car state sensor system.

Ropeless elevator systems, also referred to as self-propelled elevator systems, are useful in certain applications (e.g., high rise buildings) where the mass of the ropes for a roped system is prohibitive and there is a desire for multiple elevator cars to travel in a single hoistway, elevator shaft, or lane. There exist ropeless elevator systems in which a first lane is designated for upward traveling elevator cars and a second lane is designated for downward traveling elevator cars. A transfer station at each end of the lane is used to move cars horizontally between the first lane and second lane.

BRIEF DESCRIPTION OF THE INVENTION

According to one embodiment, an elevator system is provided that includes an elevator car configured to travel in a lane of an elevator shaft and a linear propulsion system configured to impart force to the elevator car. The linear propulsion system includes a first part mounted in the lane of the elevator shaft and a second part mounted to the elevator car configured to co-act with the first part to impart movement to the elevator car. The system further includes a plurality of car state sensors disposed within the lane and operable to determine a state space vector of the elevator car within the lane and a sensed element disposed on the elevator car, wherein each of the plurality of car state sensors is configured to detect the sensed element when the elevator car is in proximity to the respective car state sensor. A control system is operable to apply an electrical current to at least one of the first part and the second part and the plurality of car state sensors are in communication with the control system and the linear propulsion system to provide state space vector data thereto.

In addition to one or more of the features described above, or as an alternative, further embodiments may include, wherein each sensor of the plurality of car state sensors is at least one of an IR/optical transmissive sensor, an IR/optical reflective sensor, a magnetic encoder, an eddy current sensors, and a hall effect sensor.

In addition to one or more of the features described above, or as an alternative, further embodiments may include, wherein each sensor of the plurality of car state sensors is at least one of a laser Doppler device, a CMOS/CCD camera, and a laser imaging device.

In addition to one or more of the features described above, or as an alternative, further embodiments may include, wherein the plurality of car state sensors define a plurality of first car state sensors and the elevator car is a first elevator car in a first lane. The system further includes a second elevator car disposed in a second lane of the elevator shaft and a plurality of second car state sensors configured to determine the state space vector of the second elevator car.

In addition to one or more of the features described above, or as an alternative, further embodiments may include, wherein the elevator car is a first elevator car, the system further comprising a second elevator car disposed in the same lane of the elevator shaft as the first elevator car, wherein the plurality of car state sensors are configured to determine state space vector of each the first elevator car and the second elevator car.

In addition to one or more of the features described above, or as an alternative, further embodiments may include, wherein the plurality of car state sensors are further configured to determine at least one of velocity, acceleration, magnetic angle, and direction of movement of the elevator car.

In addition to one or more of the features described above, or as an alternative, further embodiments may include, wherein control system is configured to determine the state space vector of the elevator car based on the proximity of the elevator car to one or more of the plurality of car state sensors.

In addition to one or more of the features described above, or as an alternative, further embodiments may include, wherein the plurality of car state sensors are hardwired to at least one of the control system and the propulsion system.

In addition to one or more of the features described above, or as an alternative, further embodiments may include, wherein the system includes a plurality of first parts and each of the plurality of first parts has at least one associated car state sensor.

In addition to one or more of the features described above, or as an alternative, further embodiments may include, wherein the first part comprises one or more motor segments and the second comprises one or more permanent magnets.

In addition to one or more of the features described above, or as an alternative, further embodiments may include, further comprising an elevator car indicator, wherein each of the plurality of car state sensors is configured to detect an identity of the elevator car based on the elevator car indicator.

In addition to one or more of the features described above, or as an alternative, further embodiments may include, wherein the plurality of car state sensors are configured to determine the state space vector of the elevator car within the lane based on at least one of a velocity measurement, acceleration measurement, and magnetic angle measurement.

In addition to one or more of the features described above, or as an alternative, further embodiments may include, wherein the state space vector is a physical position of the elevator car.

In addition to one or more of the features described above, or as an alternative, further embodiments may include, further including an elevator car indicator configured on the elevator car and at least one additional sensor configured to detect an identity of the elevator car based on the elevator car indicator.

According to another embodiment, a method is provided, wherein the method includes measuring a state space vector of a first elevator car in a first lane of an elevator shaft with at least one of a plurality of car state sensors disposed within the first lane and a sensed element disposed on the elevator car, communicating the state space vector of the first elevator car to a control system, and controlling at least one of the speed, direction of movement, and acceleration of the first elevator car based on the measured state space vector of the first elevator car.

In addition to one or more of the features described above, or as an alternative, further embodiments may include measuring a state space vector of a second elevator car in the first lane of the elevator shaft with at least one of the plurality of car state sensors, communicating the state space vector of the second elevator car to the control system, and controlling at least one of the speed, direction of movement, and acceleration of the second elevator car based on the measured state space vector of the second elevator car.

In addition to one or more of the features described above, or as an alternative, further embodiments may include measuring a state space vector of a second elevator car in a second lane of the elevator shaft with at least one of a plurality of second car state sensors, communicating the state space vector of the second elevator car to the control system, and controlling at least one of the speed, direction of movement, and acceleration of the second elevator car based on the measured state space vector of the second elevator car.

In addition to one or more of the features described above, or as an alternative, further embodiments may include determining the identity of the first elevator car with the at least one of a plurality of car state sensors, and communicating the identity of the first elevator car to the control system.

In addition to one or more of the features described above, or as an alternative, further embodiments may include computing at least one of the speed, direction of movement, magnetic angle, and acceleration of the first elevator car based on the measured state space vector information.

In addition to one or more of the features described above, or as an alternative, further embodiments may include, wherein the method is performed by a control system of a multicar, ropeless elevator system.

Technical features of the invention include providing a car state sensing system within the hoistways, elevator shafts, or lanes of a multicar, ropeless elevator system that enables multiple elevator cars to run independently within a single lane. Further technical features of the invention include providing car identification with the car state data such that a particular or specific car state may be known. Further technical features of the invention include providing the capacity for a wired or wireless connection between various components of the sensing system to provide a robust and high bandwidth communication between the components.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
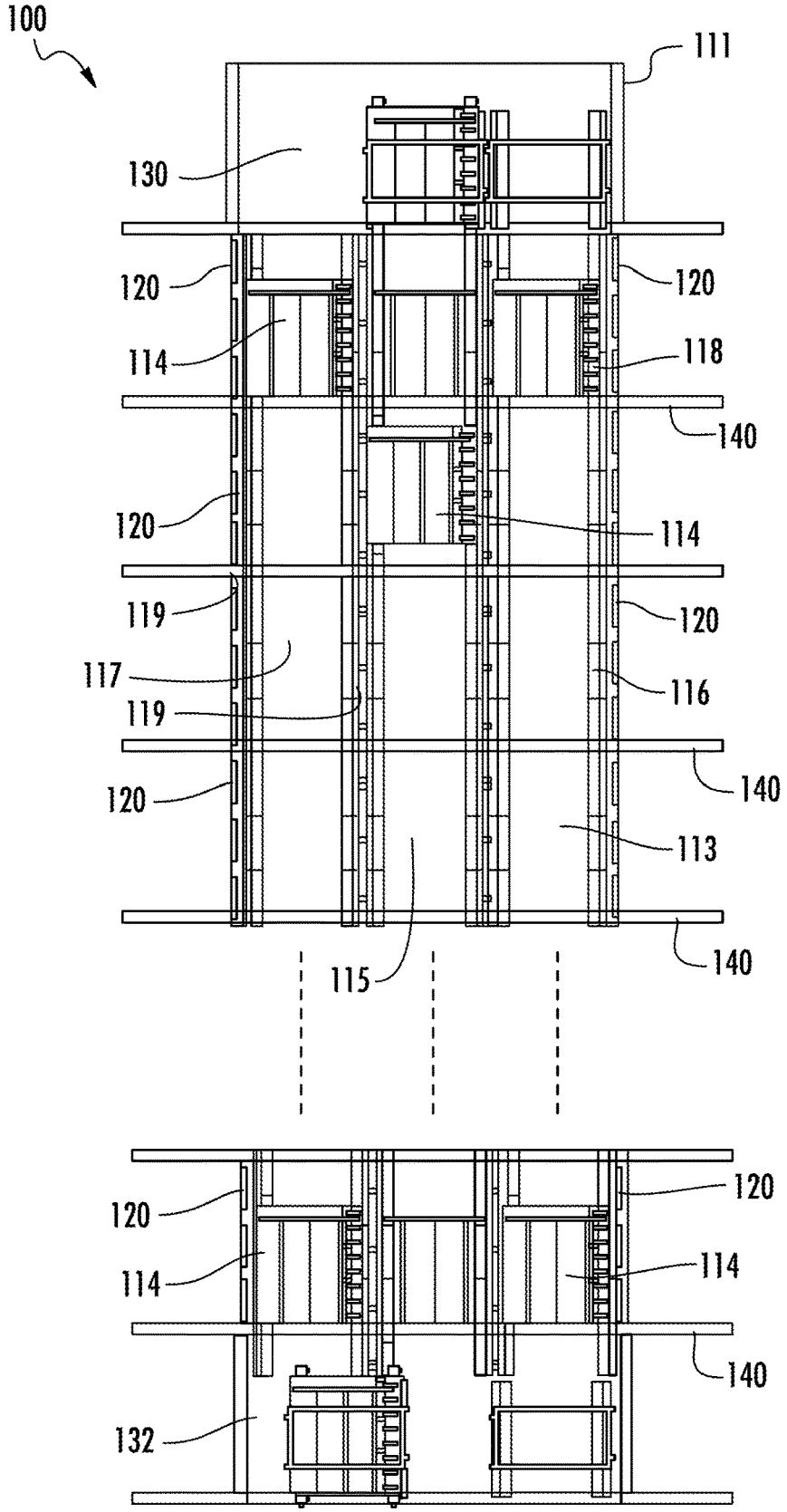
FIG. 1 depicts a multicar elevator system in an exemplary embodiment.

FIG. 1 depicts an exemplary multicar, ropeless elevator system 100 that may be employed with embodiments of the invention. Elevator system 100 includes an elevator shaft 111 having a plurality of lanes 113, 115 and 117. While three lanes 113, 115, 117 are shown in FIG. 1, it is understood that various embodiments of the invention and various configurations of a multicar, ropeless elevator system may include any number of lanes, either more or fewer than the three lanes shown in FIG. 1. In each lane 113, 115, 117, multiple elevator cars 114 can travel in one direction, i.e., up or down, or multiple cars within a single lane may be configured to move in opposite directions. For example, in FIG. 1 elevator cars 114 in lanes 113 and 115 travel up and elevator cars 114 in lane 117 travel down. Further, as shown in FIG. 1, one or more elevator cars 114 may travel in a single lane 113, 115, and 117.

As shown, above the top accessible floor of the building is an upper transfer station 130 configured to impart horizontal motion to the elevator cars 114 to move the elevator cars 114 between lanes 113, 115, and 117. It is understood that upper transfer station 130 may be located at the top floor, rather than above the top floor. Similarly, below the first floor of the building is a lower transfer station 132 configured to impart horizontal motion to the elevator cars 114 to move the elevator cars 114 between lanes 113, 115, and 117. It is understood that lower transfer station 132 may be located on the first floor, rather than below the first floor. Although not shown in FIG. 1, one or more intermediate transfer stations may be configured between the lower transfer station 132 and the upper transfer station 130. Intermediate transfer stations are similar to the upper transfer station 130 and lower transfer station 132 and are configured to impart horizontal motion to the elevator cars 114 at the respective transfer station, thus enabling transfer from one lane to another lane at an intermediary point within the elevator shaft 111. Further, although not shown in FIG. 1, the elevator cars 114 are configured to stop at a plurality of floors 140 to allow ingress to and egress from the elevator cars 114.

Elevator cars 114 are propelled within lanes 113, 115, 117 using a propulsion system such as a linear, permanent magnet motor system having a primary, fixed portion, or first part 116, and a secondary, moving portion, or second part 118. The first part 116 is a fixed part because it is mounted to a portion of the lane, and the second part 118 is a moving part because it is mounted on the elevator car 114 that is movable within the lane.

The first part 116 includes windings or coils mounted on a structural member 119, and may be mounted at one or both sides of the lanes 113, 115, and 117, relative to the elevator cars 114. Specifically, first parts 116 will be located within the lanes 113, 115, 117, on walls or sides that do not include elevator doors.

The second part 118 includes permanent magnets mounted to one or both sides of cars 114, i.e., on the same sides as the first part 116. The second part 118 engages with the first part 116 to support and drive the elevators cars 114 within the lanes 113, 115, 117. First part 116 is supplied with drive signals from one or more drive units 120 to control movement of elevator cars 114 in their respective lanes through the linear, permanent magnet motor system. The second part 118 operatively connects with and electromagnetically operates with the first part 116 to be driven by the signals and electrical power. The driven second part 118 enables the elevator cars 114 to move along the first part 116 and thus move within a lane 113, 115, and 117.

Those of skill in the art will appreciate that the first part 116 and second part 118 are not limited to this example. In alternative embodiments, the first part 116 may be configured as permanent magnets, and the second part 118 may be configured as windings or coils. Further, those of skill in the art will appreciate that other types of propulsion may be used without departing from the scope of the invention.

The first part 116, as shown in FIG. 1, is formed from a plurality of motor segments 122, with each segment associated with a drive unit 120. Although not shown, the central lane 115 of FIG. 1 also includes a drive unit for each segment of the first part 116 that is within the lane 115. Those of skill in the art will appreciate that although a drive unit 120 is provided for each motor segment 122 of the system (one-to-one) other configurations may be used without departing from the scope of the invention. Further, those of skill in the art will appreciate that other types of propulsion may be employed without departing from the scope of the invention. For example, a magnetic screw may be used for a propulsion system of elevator cars. Thus, the described and shown propulsion system of this disclosure is merely provided for exemplary and explanatory purposes, and is not intended to be limiting.

Figure 2:
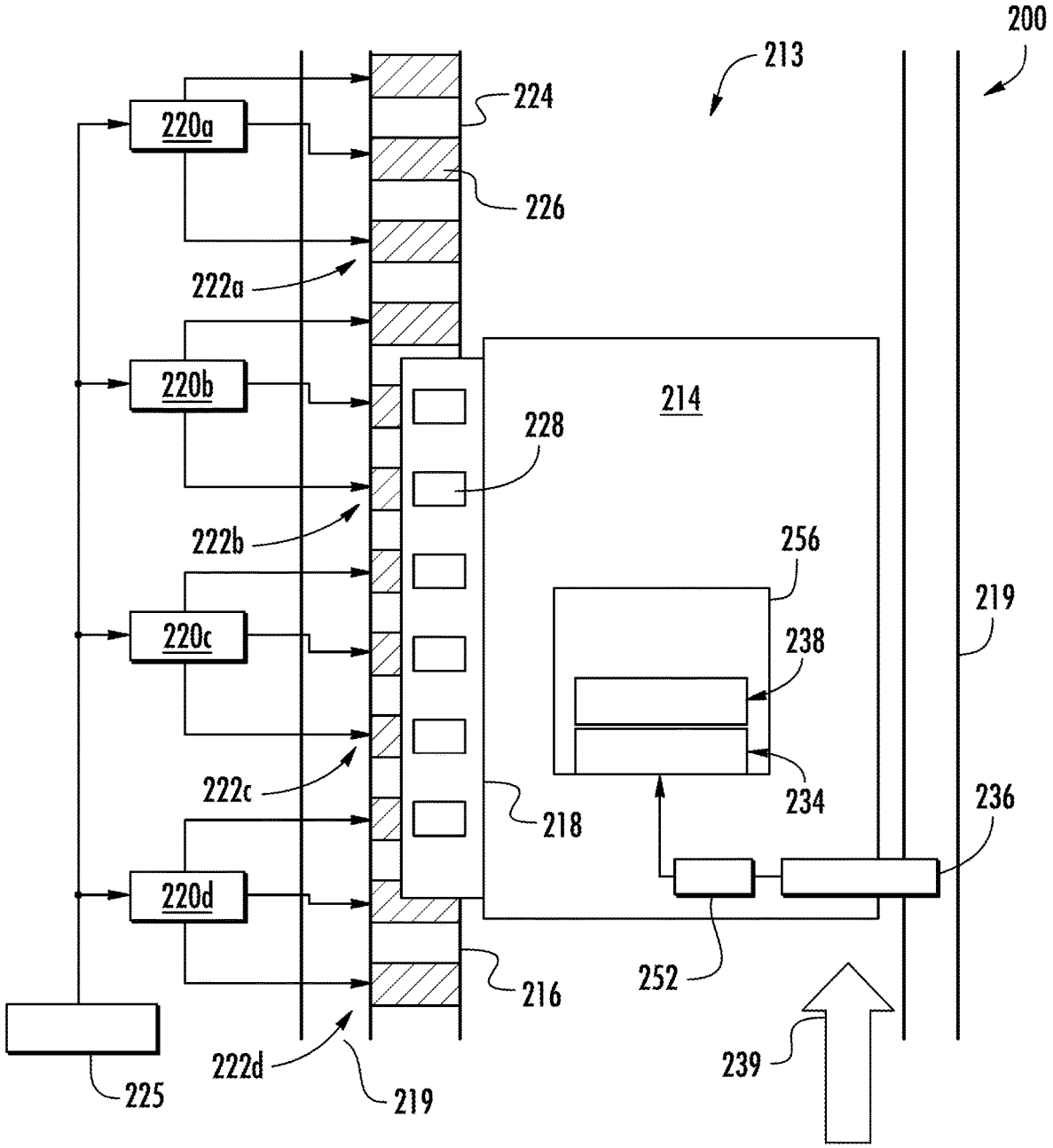
FIG. 2 depicts view of a single elevator car within a multicar elevator system in an exemplary embodiment.

Turning now to FIG. 2, a view of an elevator system 200 including an elevator car 214 that travels in lane 213 is shown. Elevator system 200 is substantially similar to elevator system 100 of FIG. 1 and thus like features are preceded by the number "2" rather than the number "1." Elevator car 214 is guided by one or more guide rails 224 extending along the length of lane 213, where the guide rails 224 may be affixed to a structural member 219. For ease of illustration, the view of FIG. 2 only depicts a single guide rail 224; however, there may be any number of guide rails positioned within the lane 213 and may, for example, be positioned on opposite sides of the elevator car 214. Elevator system 200 employs a linear propulsion system as described above, where a first part 216 includes multiple motor segments 222*a*, 222*b*, 222*c*, 222*d* each with one or more coils 226 (i.e., phase windings). The first part 216 may be mounted to guide rail 224, incorporated into the guide rail 224, or may be located apart from guide rail 224 on structural member 219. The first part 216 serves as a stator of a permanent magnet synchronous linear motor to impart force to elevator car 214. The second part 218, as shown in FIG. 2, is mounted to the elevator car 214 and includes an array of one or more permanent magnets 228 to form a second portion of the linear propulsion system of the ropeless elevator system. Coils 226 of motor segments 222*a*, 222*b*, 222*c*, 222*d* may be arranged in one or more phases, as is known in the electric motor art, e.g., three, six, etc. One or more first parts 216 may be mounted in the lane 213, to co-act with permanent magnets 228 mounted to elevator car 214. Although only a single side of elevator car 214 is shown with permanent magnets 228 the example of FIG. 2, the permanent magnets 228 may be positioned on two or more sides of elevator car 214. Alternate embodiments may use a single first part 216/second part 218 configuration, or multiple first part 216/second part 218 configurations.

In the example of FIG. 2, there are four motor segments 222*a*, 222*b*, 222*c*, 222*d* depicted. Each of the motor segments 222*a*, 222*b*, 222*c*, 222*d* has a corresponding or associated drive 220*a*, 220*b*, 220*c*, 220*d*. A system controller 225 provides drive signals to the motor segments 222*a*, 222*b*, 222*c*, 222*d* via drives 220*a*, 220*b*, 220*c*, 220*d* to control motion of the elevator car 214. The system controller 225 may be implemented using a microprocessor executing a computer program stored on a storage medium to perform the operations described herein. Alternatively, the system controller 225 may be implemented in hardware (e.g., ASIC, FPGA) or in a combination of hardware/software. The system controller 225 may also be part of an elevator control system. The system controller 225 may include power circuitry (e.g., an inverter or drive) to power the first part 216. Although a single system controller 225 is depicted, it will be understood by those of ordinary skill in the art that a plurality of system controllers may be used. For example, a single system controller may be provided to control the operation of a group of motor segments over a relatively short distance, and in some embodiments a single system controller may be provided for each drive unit or group of drive units, with the system controllers in communication with each other.

In some exemplary embodiments, as shown in FIG. 2, the elevator car 214 includes an on-board controller 256 with one or more transceivers 238 and a processor, or CPU, 234. The on-board controller 256 and the system controller 225 collectively form a control system where computational processing may be shifted between the on-board controller 256 and the system controller 225. In some exemplary embodiments, the processor 234 of on-board controller 256 is configured to monitor one or more sensors and to communicate with one or more system controllers 225 via the transceivers 238. In some exemplary embodiments, to ensure reliable communication, elevator car 214 may include at least two transceivers 238 configured for redundancy of communication. The transceivers 238 can be set to operate at different frequencies, or communication channels, to minimize interference and to provide full duplex communication between the elevator car 214 and the one or more system controllers 225. In the example of FIG. 2, the on-board controller 256 interfaces with a load sensor 252 to detect an elevator load on a brake 236. The brake 236 may engage with the structural member 219, a guide rail 224, or other structure in the lane 213. Although the example of FIG. 2 depicts only a single load sensor 252 and brake 236, elevator car 214 can include multiple load sensors 252 and brakes 236.

In order to drive the elevator car 214, one or more motor segments 222*a*, 222*b*, 222*c*, 222*d* can be configured to overlap the second part 218 of the elevator car 214 at any given point in time. In the example of FIG. 2, motor segment 222*d* partially overlaps the second part 218 (e.g., about 33% overlap), motor segment 222*c* fully overlaps the second part 218 (100% overlap), and motor segment 222*d* partially overlaps the second part 218 (e.g., about 66% overlap). There is no depicted overlap between motor segment 222*a* and the second part 218. In some embodiments, the control system (system controller 225 and on-board controller 256) is operable to apply an electrical current to at least one of the motor segments 222*b*, 222*c*, 222*d* that overlaps the second part 218. The system controller 225 can control the electrical current on one or more of the drive units 220*a*, 220*b*, 220*c*, 220*d* while receiving data from the on-board controller 256 via transceiver 238 based on load sensor 252. The electrical current may apply an upward thrust force 239 to the elevator car 214 by injecting a constant current, thus propelling the elevator car 214 within the lane 213. The thrust produced by the linear propulsion system is dependent, in part, on the amount of overlap between the first part 216 with the second part 218. The peak thrust is obtained when there is maximum overlap of the first part 216 and the secondary portion 218.

In traditional rotary drive, roped, elevator systems, the position of the elevator car could be determined accurately by a rotary encoder or similar device that measured the rotation of a rotor or spool and could determine the position of the car based on the amount/length of rope that was deployed. However, ropeless elevator systems void the applicability for rotary encoder and rotary motors as no rope or rotor is used. Further, because multiple cars can be located within a single lane, a single sensor at the top of the lane is not feasible (see, e.g., FIG. 1).

Figure 3:
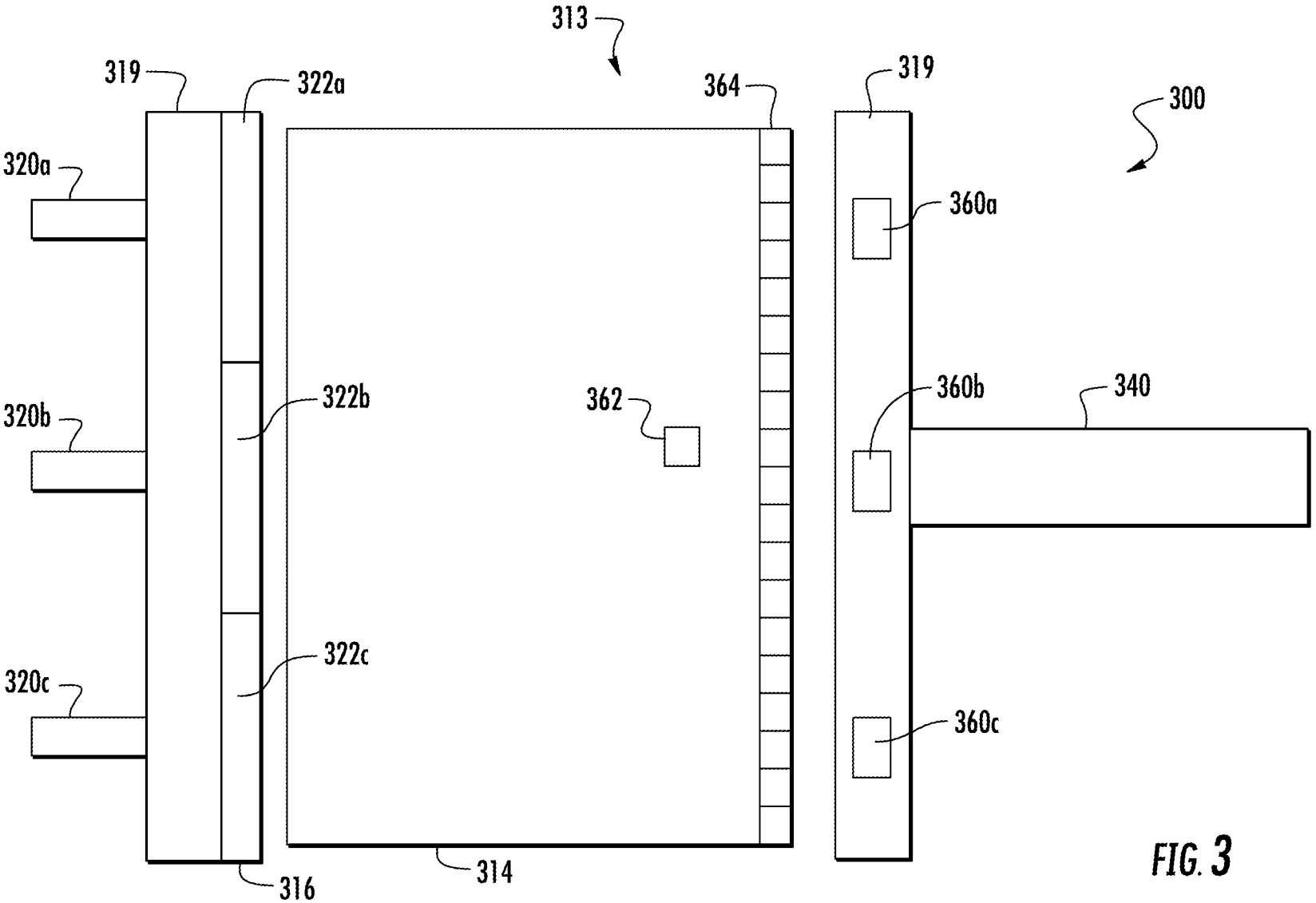
FIG. 3 depicts a view of a single elevator car and a sensing system in accordance with a first exemplary embodiment.

Turning now to FIG. 3, a schematic view of a first exemplary embodiment of the sensing system of the invention is shown. Elevator system 300 includes features as discussed above with respect to FIGS. 1 and 2, and thus similar features are preceded with a "3" rather than a "1" or "2," respectively. Car 314 is located within a lane 313 and configured to move in an upward or downward direction, depending on the control signals provided by drive units 320*a*, 320*b*, 320*c* and/or a system controller as described above with respect to FIG. 2. Each drive unit 320*a*, 320*b*, 320*c* is operatively connected to an associated motor segment 322*a*, 322*b*, 322*c* of the first part 316. Although not shown, car 314 will include a second part (see elements 118, 218) that will enable propulsion and driving of the car 314 within the lane 313.

In operation, drive units 320*a*, 320*b*, 320*c* can energize the associated motor segments 322*a*, 322*b*, 322*c* of the first part 316, respectively, to propel one or more elevator cars 314 upward within the lane 313. Alternatively, the motor segments 322*a*, 322*b*, 322*c* of the first part 316 can operate as a regenerative brake to control descent of an elevator car 314 in the lane 313 and provide current back to the drive units 320*a*, 320*b*, 320*c*, for example, to recharge an electrical system connected to the drive units 320*a*, 320*b*, 320*c*.

The drive units 320*a*, 320*b*, 320*c* are connected to and/or retained on or near the structural member 319 of the lane 313. Further, the motor segments 322*a*, 322*b*, 322*c* of the first part 316 are connected to and/or retained on or near the structural member 319 of the lane 313. Although shown with the drive unit 320*a*, 320*b*, 320*c* separate from the respective motor segments 322*a*, 322*b*, 322*c* of the first part 316, those of skill in the art will appreciate that the components may be configured as a single, integral unit, or sub-combinations thereof. To provide accurate location data and control within elevator system 300 a second system is provided.

Located on the structural member 319 may be one or more sensors 360*a*, 360*b*, 360*c* of a sensing system. As shown, the sensors 360*a*, 360*b*, 360*c* are on an opposite side of the lane 213 from respective, laterally adjacent drive units 320*a*, 320*b*, 320*c* and motor segments 322*a*, 322*b*, 322*c* of the first part 316. However, this is not a limiting example but rather shown for ease of explanation, and those skilled in the art will appreciate that other configurations may be used without departing from the scope of the invention. Further, although shown in FIG. 3 as a single lane 213, those of skill in the art will appreciate that any number of lanes may employ sensing systems and configurations as described herein, and each lane may contain a plurality of sensors, such as an array or series of sensors. For example, each lane 113, 115, and 117 of FIG. 1 may be configured with the sensing system of FIG. 3 and may span the entire length of the lanes 113, 115, and 117.

Sensors 360*a*, 360*b*, 360*c* are configured to be in electrical and digital communication with the respective drive unit 320*a*, 320*b*, 320*c* that is adjacent to it (i.e., at the same vertical position within the building or vertical position within the lane 313). For example, as shown in FIG. 3, the drive unit 320*a* at the top of the image is configured to be in communication with the sensor 360*a* at the top of the image. Similarly, drive unit 320*b* is configured to communicate with sensor 360*b*, and drive unit 320*c* is configured to communicate with sensor 360*c*. Accordingly, the proposed configuration is a lateral communication at the same level within the lane 313. However, those of skill in the art will appreciate that other configurations may be employed without departing from the scope of the invention. For example, a single drive unit may be in communication with more than one sensor, or vice versa. The communication between the drive units and the sensors, and vice versa, may be by any known means, such as a wired connection, a wireless connection, etc. The selection may be based on the needs and design of the elevator system 300 and/or the sensing system. For example, to provide a high bandwidth, and thus very quick and efficient communication between the component parts, a wired connection may be preferred.

The series or array of elevator car state sensors 360*a*, 360*b*, 360*c* are fixed to stationary points along the lane 313 and attached to the structural member 319. The car state sensors 360*a*, 360*b*, 360*c* are configured to sense or determine a state of the elevator car, such as the position, velocity, and/or acceleration of an elevator car 314 as the elevator car 314 passes by the respective car state sensor 360*a*, 360*b*, 360*c*. Thus, the location of the elevator car 314 within the lane 313 may be determined based upon the location sensed by the car state sensors 360*a*, 360*b*, 360*c*. Thus, in some embodiments, the car state sensors are always active, and the control system selects which sensors to use for making state determinations based on the particular elevator car and/or on the car state sensor positions. In alternatively embodiments, car state sensors may become active based on proximity to a car, and thus the system may determine a car state based on active sensors within lane 313, e.g., car state sensors that are activated when an elevator car is in proximity to the sensors. Further, in some embodiments, always active car state sensors may be configured to help identify and/or locate uncontrolled elevator cars.

Car state sensors, in accordance with embodiments of the invention may be sensors configured to measure or determine a state space vector, which may be position, velocity, acceleration, motor magnetic angle, direction of movement, etc. When the state space vector is position, the car state sensor may directly determine the physical position or location of an elevator car. In other embodiments, the car state sensors may be configured to sense or determine the velocity of an elevator car and from this information position and/or acceleration may be derived. In other embodiments, the car state sensors may be configured to detect motor magnetic angle which is used for motor control, and from this car position, speed, and/or acceleration may be determined. However, in all embodiments, the car state sensors are configured to determine, whether directly or indirectly through derivation, at least the physical position or location of one or more elevator cars. Moreover, in some embodiments, the car state sensor(s) may be used to derive motor magnetic angle or other characteristics for motor control feedback.

As discussed above, the car state sensors 360*a*, 360*b*, 360*c* are configured to be in communication with the drive units 320*a*, 320*b*, 320*c*. In some embodiments the car state sensors 360*a*, 360*b*, 360*c* may also be, or alternatively be, in communication with a larger control system or controller and/or a computerized system that controls the ropeless elevator system such as system controller 325 or the larger central control system described above. The array of car state sensors 360*a*, 360*b*, 360*c* is configured to enable the elevator system 300 to continually determine the position of the car 314 relative to the lane 313, which may be in the form of car position data. The car position data may be incremental, such that when car 314 enters a sensing area of a new car state sensor the incremental change may be detected, i.e., moving vertically from a first car state sensor 360*a* to the next car state sensor 360*b* within the lane 313. The sensing area of each car state sensor 360*a*, 360*b*, 360*c* may be defined as the physical space substantially proximate and/or adjacent to the physical location of the respective sensor. In some embodiments the car state sensors may be configured to always be active and in other embodiments the car state sensors may be configured to be active only when an elevator car is present in the sensing range or area of the sensor, as known in the art of sensors.

When sensing, an individual car state sensor 360*a*, 360*b*, 360*c* can start an incremental position count based on the movement of the car 314. Because the position of the car state sensor 360*a*, 360*b*, 360*c* within the lane 313 is an absolute known location, the measurement by the sensor can determine the exact location of a car 314. Further, because the position of the car 314 relative to the car state sensors 360*a*, 360*b*, 360*c* may be incremental, i.e., changing in time, the elevator system 300 can determine a speed and/or an acceleration/deceleration based on the incremental change of position of the car 314 relative to a specific car state sensor 360*a*, 360*b*, 360*c*.

Alternatively, in some embodiments the position of the elevator car 314 may be determined as an absolute location. For example, rather than relying on an incremental change of position relative to a sensor, the sensor can determine the exact location of the car 314. In this example, a data point of the elevator car position can provide a unique value associated with a position within the lane 313. In this way, both the location of the car state sensor 360*a*, 360*b*, 360*c* is absolutely known and the position of the car 314 is absolute relative to each car state sensor 360*a*, 360*b*, 360*c*.

Further, in some embodiments, the car 314 may be configured with an identification mechanism 362 such that the car state sensors 360*a*, 360*b*, 360*c* can identify the specific car 314 that is present in the sensing area. Thus, not only can the elevator system 300 determine the position, speed, direction, and acceleration of a car 314 that is in the lane 313, the elevator system 300 can also determine which specific car 314 is located at the specific location, traveling at what speed, in which direction, and the acceleration of the specific car 314. In some alternative embodiments, as will be appreciated those of skill in the art, the identification mechanism 362 may coact with an additional sensor configured for this purpose, in addition to or instead of the car state sensors 360*a*, 360*b*, 360*c*. For example, and RFID chip and sensor configuration may be employed to determine which specific elevator car is being sensed by the system.

In order to measure and/or sense an elevator car 312 portion, in some embodiments, for example as shown in FIG. 3, the position sensing system may employ a sensed element 364. Sensed element 364 may be used as a baseline, guideline, reference, and may be configured as a scale, discrete target, and/or some other type of marking/device that may be sensed or registered by the car state sensors 360*a*, 360*b*, 360*c*. In such embodiments, various technologies may be employed for sensing the presence and position of the car 314 by sensing or registering the scale 364 or a portion thereof. For example, such technologies may include, but are not limited to, IR/optical transmissive, IR/optical reflective, magnetic encoder, eddy current sensor, Hall Effect sensor, etc. The scale 364 may provide an incremental measuring wherein each box or marking of the scale 364 may indicate a particular position on the car 314, and thus a car state sensor 360*a*, 360*b*, 360*c* can determine the movement of the car 314, upward or downward, and also speed, direction, acceleration, and/or deceleration may be calculated. The scale 364 may enable the determination of absolute location when the elevator car 314 first passes or enters the sensing area of a sensor. Then, continued monitoring and/or measuring may provide incremental measurements, such that incremental quadrature wave analysis may be conducted while the car 314 is in front of or in proximity to a particular sensor.

The scale 364 may be configured as a tape or other form of marking(s) that are configured to be read, sensed, registered, and/or detected by the car state sensors 360*a*, 360*b*, 360*c*. For example, the scale 364 may be formed from a tape or other marking, such as paint, ink, dye, physical structure, etc. on the car 314, that provides contrasting colors, shapes, indicators, etc. that are sensed, detected, or employed by the car state sensors 360*a*, 360*b*, 360*c*. These examples are merely provided for exemplary and explanatory purposes and other types of markings or scales may be used without departing from the scope of the invention.

Figure 4:
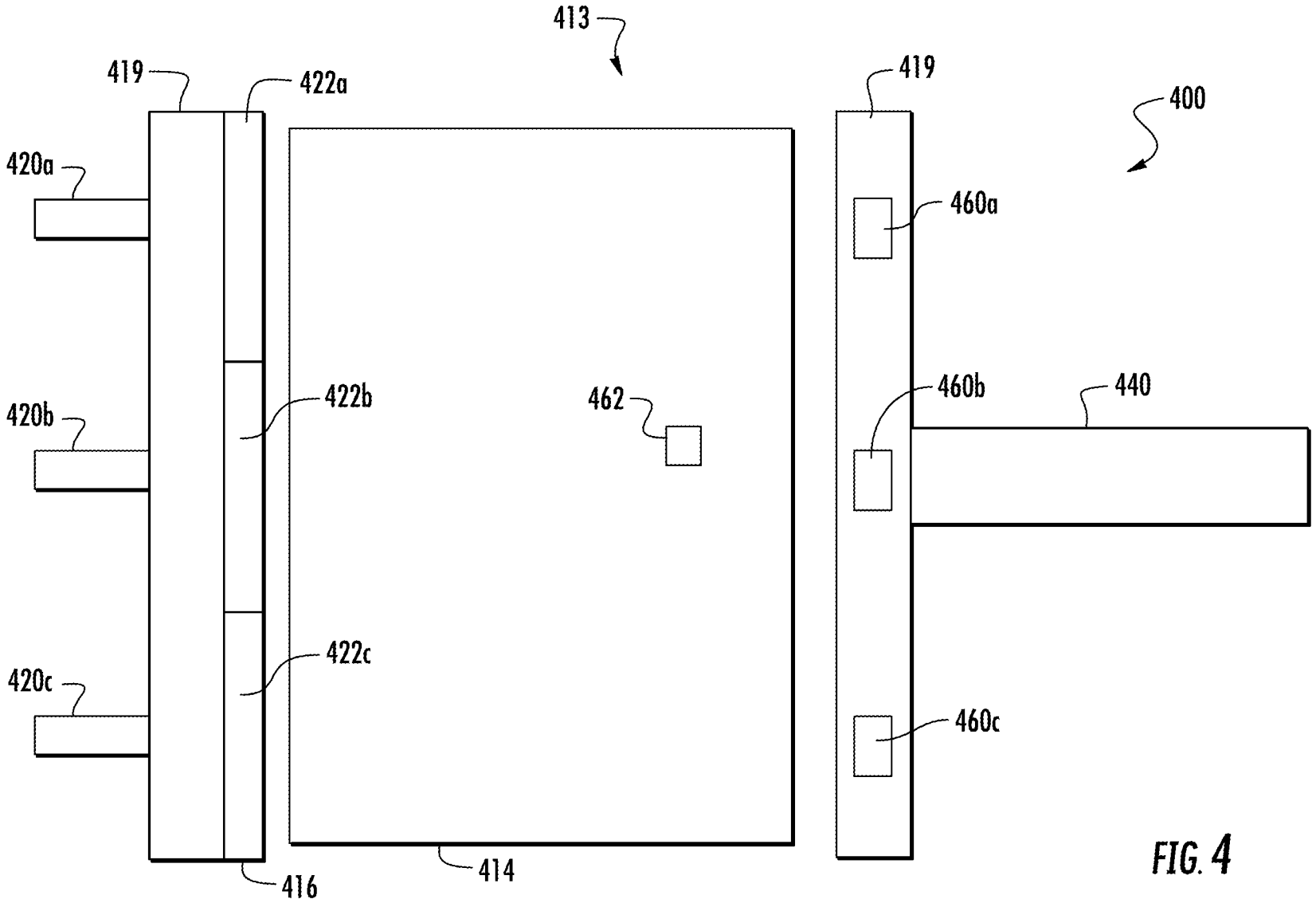
FIG. 4 depicts a view of a single elevator car and a sensing system in accordance with a second exemplary embodiment.

Turning now to FIG. 4, a schematic view of a second exemplary embodiment of the sensing system of the invention is shown. Elevator system 400 includes features as discussed above with respect to FIGS. 1-3, and thus similar features are preceded with a "4" rather than a "1," "2," or "3," respectively. Elevator system 400 is substantially similar to elevator system 300 of FIG. 3, with the primary difference being the omission of scale 364. In this embodiment, the car 414 acts as the sensed feature and the car state sensors 460*a*, 460*b*, 460*c* may be configured to include one or more of the following technologies, for example, laser Doppler, CMOS/CCD camera, and laser imaging system. Those of skill in the art will appreciate that other types of sensors may be employed without departing from the scope of the invention. In these exemplary embodiments, a sensor may determine when a car enters the sensing area without need of a scale or other mechanism/device (i.e., without scale 364 of FIG. 3).

Advantageously, in accordance with various embodiments of the invention, accurate sensing of the physical location of elevator cars within a multicar, ropeless elevator system is provided. Further, information collected by the sensors of the invention can be used for controlling the entire ropeless elevator system, such as a user, technician, automated control system, etc. can know the precise physical location of a specific elevator car. Thus, efficient car delivery and control can be provided, such that the overall system efficiency is improved. Further, advantageously, the sensing system provided herein enables accurate measurement and monitoring of car speed, direction, and acceleration, in addition to car location.

Further, advantageously, embodiments of the invention provide information that enables the elevator system, or a user thereof, to actively and precisely control the cars in a multicar, ropeless elevator system.

Moreover, advantageously, a hard-wired communication link between the sensors disclosed herein and the control and drive portions of the multicar, ropeless elevator system enables very quick and efficient control and timing with almost no latency and very high reliability within the system.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments and/or features.

For example, although described herein where a single elevator car was described with accompanying sensors and controls, those of skill in the art will appreciate that the sensors and system provided herein can be used to track any number of cars, and uniquely track each car. Further, in some alternative embodiments, each car in the multicar system may have a dedicated control and drive system associated therewith. In such embodiments, a sensing array as described herein may be associated with each control/drive system, or a controller may be employed such that a single sensing array is used to assist in the control and monitoring of a plurality of elevator cars that are each controlled and driven by a difference system.

Accordingly, the invention is not to be seen as limited by the foregoing description, but is only limited by the scope of the appended claims.

What is claimed is:

1. An elevator system comprising:

an elevator car configured to travel in a lane of an elevator shaft;

a linear propulsion system configured to impart force to the elevator car, the linear propulsion system comprising:

a first part mounted in the lane of the elevator shaft; and a second part mounted to the elevator car configured to co-act with the first part to impart movement to the elevator car;

a plurality of car state sensors disposed within the lane and operable to determine a state space vector of the elevator car within the lane;

a sensed element disposed on the elevator car, wherein each of the plurality of car state sensors is configured to detect the sensed element when the elevator car is in proximity to the respective car state sensor; and a control system operable to apply an electrical current to at least one of the first part and the second part, wherein the plurality of car state sensors are in communication with the control system and the linear propulsion system to provide state space vector data thereto, and an elevator car identification mechanism arranged on the elevator car and configured to be detected by the plurality of car state sensors, wherein each of the plurality of car state sensors is configured to detect an identity of the elevator car based on the elevator car identification mechanism such that the identity of the specific elevator car, the location of the specific elevator car within the lane, and state space vector data are known by the control system.

2. The elevator system of claim 1, wherein each sensor of the plurality of car state sensors is at least one of an IR/optical transmissive sensor, an IR/optical reflective sensor, a magnetic encoder, an eddy current sensors, and a hall effect sensor.

3. The elevator system of claim 1, wherein each sensor of the plurality of car state sensors is at least one of a laser Doppler device, a CMOS/CCD camera, and a laser imaging device.

4. The elevator system of claim 1, wherein the plurality of car state sensors define a plurality of first car state sensors and the elevator car is a first elevator car in a first lane, the system further comprising:

a second elevator car disposed in a second lane of the elevator shaft; and a plurality of second car state sensors configured to determine the state space vector of the second elevator car.

5. The elevator system of claim 1, wherein the elevator car is a first elevator car, the system further comprising a second elevator car disposed in the same lane of the elevator shaft as the first elevator car, wherein the plurality of car state sensors are configured to determine state space vector of each the first elevator car and the second elevator car.

6. The elevator system of claim 1, wherein the plurality of car state sensors are further configured to determine at least one of velocity, acceleration, magnetic angle, and direction of movement of the elevator car.

7. The elevator system of claim 1, wherein control system is configured to determine the state space vector of the elevator car based on the proximity of the elevator car to one or more of the plurality of car state sensors.

8. The elevator system of claim 1, wherein the plurality of car state sensors are hardwired to at least one of the control system and the propulsion system.

9. The elevator system of claim 1, wherein the system includes a plurality of first parts and each of the plurality of first parts has at least one associated car state sensor.

10. The elevator system of claim 1, wherein the first part comprises one or more motor segments and the second comprises one or more permanent magnets.

11. The elevator system of claim 1, wherein the elevator car identification mechanism is an RFID chip.

12. The elevator system of claim 1, wherein the plurality of car state sensors are configured to determine the state space vector of the elevator car within the lane based on at least one of a velocity measurement, acceleration measurement, and magnetic angle measurement.

13. The elevator system of claim 1, wherein the state space vector is a physical position of the elevator car.

14. The elevator system of claim 1, further comprising:

an elevator car indicator configured on the elevator car; and at least one additional sensor configured to detect an identity of the elevator car based on the elevator car indicator.

15. A method comprising:

measuring a state space vector of a first elevator car in a first lane of an elevator shaft with at least one of a plurality of car state sensors disposed within the first lane and a sensed element disposed on the elevator car;

communicating the state space vector of the first elevator car to a control system;

controlling at least one of the speed, direction of movement, and acceleration of the first elevator car based on the measured state space vector of the first elevator car;

determining the identity of the first elevator car with the at least one of a plurality of car state sensors, based on an elevator car identification mechanism arranged on the first elevator car;

communicating the identity of the first elevator car to the control system; and associating a location and the measured state space vector to the identified first elevator car.

16. The method of claim 15, further comprising:

measuring a state space vector of a second elevator car in the first lane of the elevator shaft with at least one of the plurality of car state sensors;

communicating the state space vector of the second elevator car to the control system; and controlling at least one of the speed, direction of movement, and acceleration of the second elevator car based on the measured state space vector of the second elevator car.

17. The method of claim 15, further comprising:

measuring a state space vector of a second elevator car in a second lane of the elevator shaft with at least one of a plurality of second car state sensors;

communicating the state space vector of the second elevator car to the control system; and controlling at least one of the speed, direction of movement, and acceleration of the second elevator car based on the measured state space vector of the second elevator car.

18. The method of claim 15, further comprising computing at least one of the speed, direction of movement, magnetic angle, and acceleration of the first elevator car based on the measured state space vector information.

19. The method of claim 15, wherein the method is performed by a control system of a multicar, ropeless elevator system.

* * * * *